United States Patent [19]

Yasuhara

[11] 4,368,709

[45] Jan. 18, 1983

[54] FUEL INJECTION PUMP WITH AN INJECTION TIMING CONTROL DEVICE

[75] Inventor: Seishi Yasuhara, Yokosuka, Japan

[73] Assignee: Nissan Motor Company, Limited, Kanagawa, Japan

[21] Appl. No.: 248,671

[22] Filed: Mar. 30, 1981

[30] Foreign Application Priority Data

Mar. 31, 1980 [JP] Japan ..... 55-41448
Jul. 31, 1980 [JP] Japan ..... 55-105520

[51] Int. Cl.[3] ..... F02M 59/20
[52] U.S. Cl. ..... 123/502
[58] Field of Search ..... 123/501, 502; 417/289, 417/462

[56] References Cited

U.S. PATENT DOCUMENTS

| | | | |
|---|---|---|---|
| 4,143,632 | 3/1979 | Kobayashi | 123/502 |
| 4,271,806 | 6/1981 | Kaibara et al. | 123/502 |
| 4,273,088 | 6/1981 | Hofmann et al. | 123/502 |
| 4,292,940 | 10/1981 | Bailey | 123/501 |

FOREIGN PATENT DOCUMENTS

| | | | |
|---|---|---|---|
| 2062298 | 5/1981 | United Kingdom | 123/502 |

*Primary Examiner*—Larry I. Schwartz

*Attorney, Agent, or Firm*—Lowe, King, Price & Becker

[57] ABSTRACT

A distributor type fuel injection pump is disclosed for use with a diesel engine for successively supplying pressurized fuel to engine injectors in synchronism with engine rotation. The fuel injection pump includes an angularly movable control member adapted to determine the timing of fuel injection in accordance with its angular position. An injection timing control device is provided which comprises a casing, a piston drivingly connected to the control member and located for reciprocation within the casing to form two chambers at the respective ends thereof. The piston if formed therein with pressure passages communicating a pressure source with the pressure chambers, respectively. Control circuit means is provided which calculates an optimum injection timing value from various engine operating parameters and provides a control signal indicative of the calculated injection timing value. The control signal is applied to valve means which thereby varies the ratio between the effective areas of the pressure passages to create a pressure difference across the piston, whereby the piston moves to move the control member to an angular position corresponding to the calculated injection timing value.

11 Claims, 9 Drawing Figures

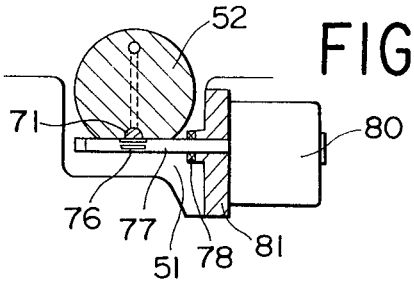
FIG. 4
FIG. 5
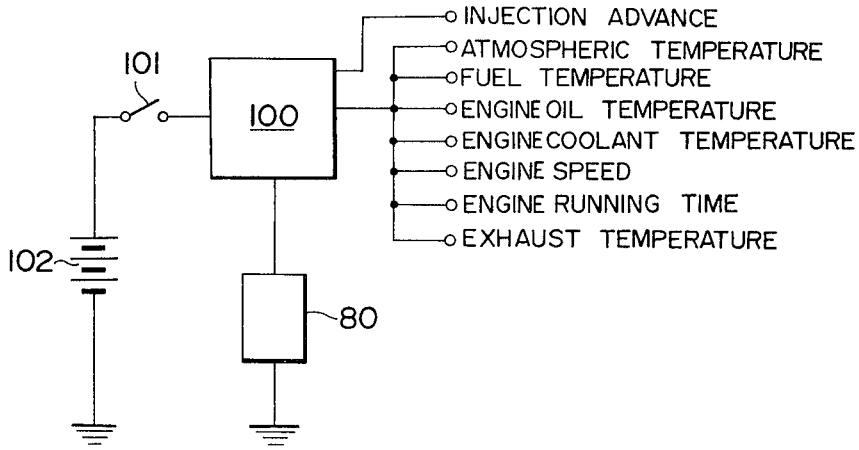
FIG. 6
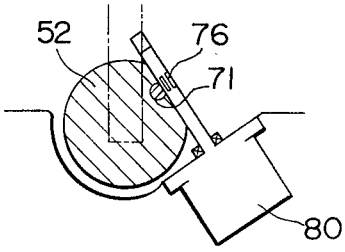
FIG. 7
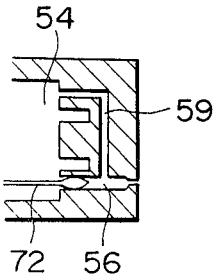

FUEL INJECTION PUMP WITH AN INJECTION TIMING CONTROL DEVICE

BACKGROUND OF THE INVENTION

1. Field of the Invention

This invention relates to a fuel injection pump for use with diesel engines and, more particularly, to a distributor type fuel injection pump equipped with an automatic injection timing control device.

2. Description of the Prior Art

Fuel injection pumps have been used with diesel engines for operating them with varying the timing of fuel injection as a function of the frequency of rotation of the engine. It is desirable to assure stable engine operation over the full running range by controlling the injection timing in accordance with various engine operating parameters. For example, it is the common practice to give an advance to the injection timing during engine starting for high engine starting stability.

For this purpose, distributor type fuel injection pumps have been proposed for successively supplying pressurized fuel to engine injectors in synchronism with engine rotation. Such fuel injection pumps includes an angularly movable control member adapted to determine the timing of fuel injection in accordance with its angular position, and an injection timing control device for varying the angular position of the control member as a function of engine speed. However, such an injection timing control device suffers from certain disadvantages as described later in detail.

The present invention provides a distributor type fuel injection pump equipped with a simple and compact injection timing control device capable of controlling the injection timing with high accuracy and high response to engine operating conditions.

SUMMARY OF THE INVENTION

The present invention provides a distributor type fuel injection pump for use with a diesel engine for successively supplying pressurized fuel to engine injectors in synchronism with engine rotation. The fuel injection pump includes an angularly movable control member adapted to determine the timing of fuel injection in accordance with its angular position, and an injection timing control device for varying the angular position of the control member. The injection timing control device comprises a casing, a piston drivingly connected to the control member and located for reciprocating movement within the casing to form first and second pressure chambers at the respective ends thereof. The first pressure chamber has a first release port and a first inlet port. The second pressure chamber has a second release port and a second inlet port. The piston is formed therein with first and second pressure passages, the first passage communicating a pressure source with the first inlet port and the second passage communicating the pressure source with the second inlet port.

The injection timing control device also comprises control circuit means which calculates an optimum injection timing value for an engine operating condition from various engine operating parameters and provides a control signal indicative of the calculated injection timing value. The control signal is applied to valve means which thereby varies the ratio of the effective area of the first pressure passage to that of the second pressure passage to create a pressure difference across the piston, whereby the piston moves to move the control member to an angular position corresponding to the calculated injection timing value.

The valve means comprises a plunger located for reciprocating movement within a guide bore formed in the piston in aligned relationship with the first and second inlet ports, and drive means for moving the plunger to a target position corresponding to the calculated injection timing value.

In a preferred form, the plunger may have a needle valve extending from its one end toward the first inlet port for closing the first release port when the plunger is in its position nearest to the first pressure chamber.

In another preferred form, resilient means is provided for urging the plunger in the direction opposite to the direction of movement of the plunger.

BRIEF DESCRIPTION OF THE DRAWINGS

The present invention will be described in greater detail by reference to the following description taken in connection with the accompanying drawings, where like reference numerals refer to the same or corresponding parts, and in which:

FIG. 4 is a sectional view of the injection timing control device taken along the lines I—I of FIG. 3;

FIG. 5 is a circuit diagram showing a control circuit for use in the injection timing control device of the present invention;

FIG. 6 is a sectional view showing a modified form of the injection timing control device;

FIG. 7 is a fragmentary sectional view showing another modified form of the injection timing control device;

DESCRIPTION OF THE PREFERRED EMBODIMENTS

Figure 1:
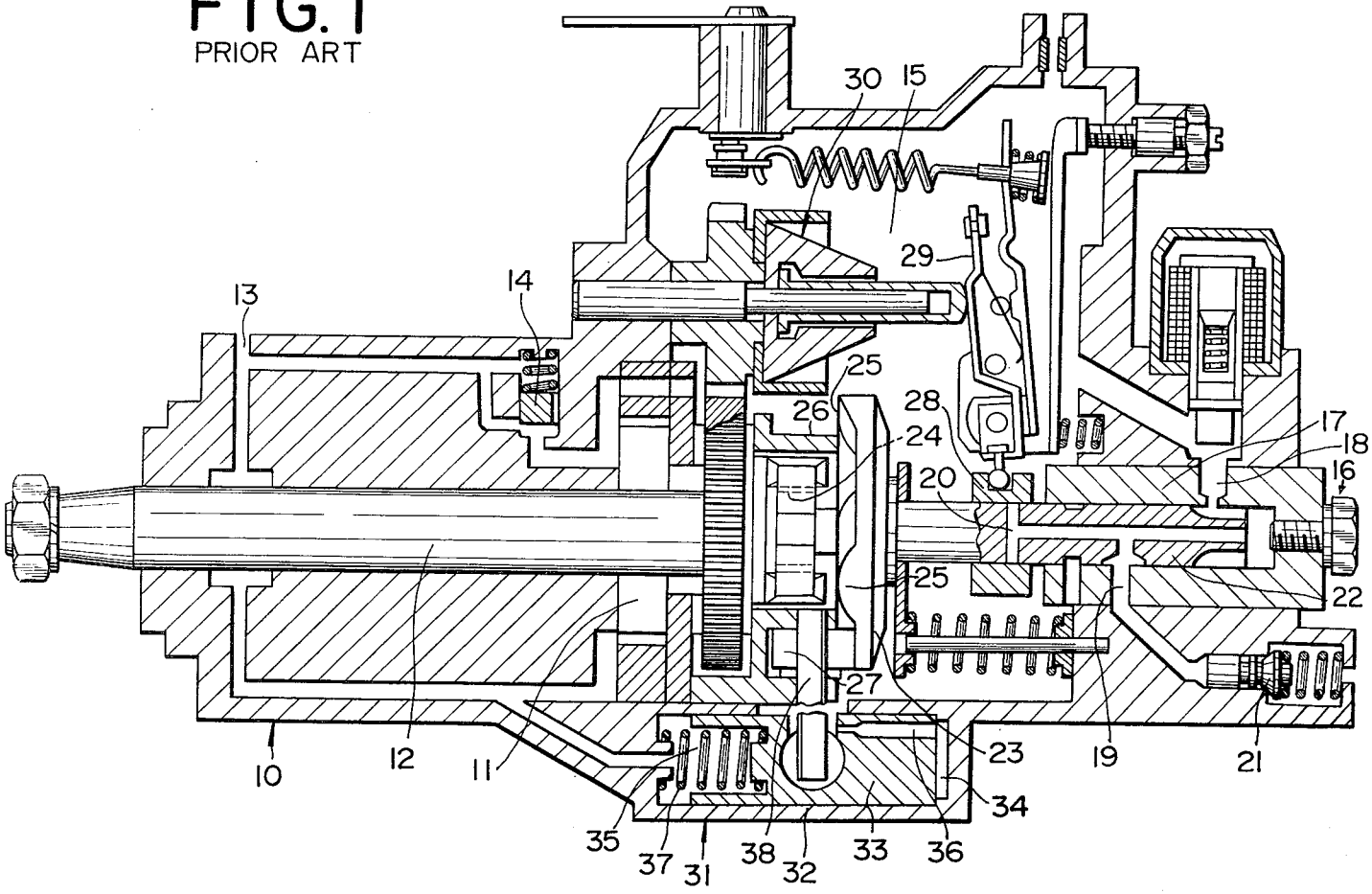
FIG. 1 PRIOR ART
FIG. 1 is a longitudinal sectional view of a conventional fuel injection pump with the injection timing control device being shown as rotated clockwisely 90 degrees from its actual position for convenience of illustration.
Figure 2:
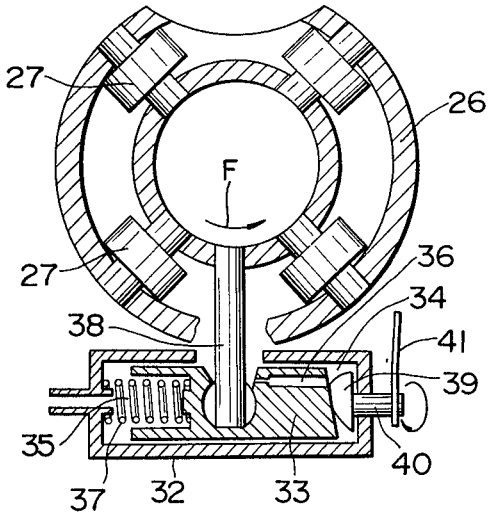
FIG. 2 PRIOR ART
FIG. 2 is a transverse sectional view showing the relative relationship between the roller ring and the injection timing control device.

Prior to the description of the preferred embodiments of the present invention, I shall briefly describe the prior art fuel injection pump in FIGS. 1 and 2, in order to specifically point out the disadvantages attendant thereon.

Referring to FIG. 1, the conventional distributor type fuel injection pump comprises a pump housing 10 which contains therein a feed pump 11 driven by a drive shaft 12 drivingly connected with the engine (not shown). The feed pump 11 sucks fuel through an inlet 13 from a fuel reservoir (not shown) and discharges pressurized fuel through a pressure regulating valve 14 into a pump chamber 15 formed in the pump housing 10. The fuel charged into the pump chamber 15 is used to lubricate parts located within the pump chamber 15 and also is delivered to a piston valve 16. The piston valve 16 includes a cylinder 17 fixed to the pump housing 10 and formed with an inlet port 18 opening into the pump chamber 15, distributing ports 19 communicated with respective delivery valves 21, and a spill port 20.

Provided for rotation and reciprocation within the cylinder 16 is a distributing piston 22 having therein a passage for selectively connecting two of the ports 18, 19 and 20. The distributing piston 22 is fixed to a cam disc 23 which, in turn, is connected through a suitable coupling 24 to the drive shaft 12. The cam disc 23 is formed on its surface with face cams 25 numbered in accordance with the cylinders of the engine. A roller ring 26 is provided which supports rollers 27 for engagement with the face cams 25 of the cam disc 23. As the drive shaft 12 rotates, the cam disc 23 rotates with its face cams 25 running over the rollers 27, causing rotating and reciprocating movement of the distributing piston 22. The distributing piston 22 moves to the right a distance equal to the cam lift when the face cam runs on the rollers. As a result of the rotating and reciprocating movement of the distributing piston 22, pressurized fuel is fed from the distributing ports 19 to the delivery valve 18 and hence to the fuel injectors (not shown) for the engine.

The amount of fuel injected through the fuel injectors is determined by the position of a spill ring 28. The spill ring 28 is mounted around a portion of the outer peripheral surface of the distributing piston 22 to cover the spill port 20 when the distributing piston 22 moves to the left in the drawing and open the spill port 20 to release pressurized fuel into the interior of the pump chamber 15 when it moves to the right in the drawing.

The position of the spill ring 28 is adjusted through a link lever 29 by a governor mechanism 30 which is drivingly connected to the drive shaft 12 so that the amount of fuel to the fuel injectors is controlled in accordance with the frequency of rotation of the engine.

The timing of fuel injection which occurs when the face cams 25 runs on the rollers 27 is controlled by the angular position of the roller ring 26 with respect to the cam disc 23. For example, if the roller ring 26 is rotated in a direction opposite to the direction of rotation of the cam disc 23, the face cams 25 ride on the roller 27 at an earlier time so that the fuel injection timing can be advanced with respect to engine crank angle. For this purpose, an injection timing control device 31 is provided to vary the angular position of the roller ring 26 in accordance with the frequency of rotation of the engine.

Referring to FIG. 2, the injection timing control device 31 includes a cylinder 32 and a piston 33 reciprocally located in the bore of the cylinder 32 to divide the cylinder bore into two chambers 34 and 35 at the respective ends of the piston 33. The chamber 34 is communicated through a passage 36 with the pump chamber 15. The chamber 35 is connected to the inlet side of the feed pump 11 and held at a low pressure. A spring 37 is provided within the chamber 35 to urge the piston 33 to the right in the drawing. The piston 33 is formed with a recess which receives one end of a drive pin 38 extending through the pump chamber 15 to the roller ring 26.

The fuel pressure in the pump chamber 15 increases in proportion to increase in the frequency of rotation of the feed pump 11 and thus the engine speed, causing leftward movement of the piston 33 to rotate the roller ring 26 in a direction opposite to the direction of rotation of the cam disc 23 indicated in FIG. 2 by the arrow F, and as a result fuel injection is advanced in accordance with engine speed.

In addition, the injection timing control device 31 is associated with a manual injection advance means for moving the piston 33 leftwardly against the force of the spring 37 in order to provide an advance to the fuel injection timing during engine starting. The manual injection advance means 31 includes a cam 39 having a slant face in contact with the piston 33. The cam 39 is rotated through a rotary shaft 40 by a hand-operated lever 41 to force leftward movement of the piston 33 so that fuel can be injected with an advance corresponding to a predetermined crank angle.

In such a conventional injection timing control device where injection timing advance necessary during engine starting is made by manual rotation of the lever 41, however, complex engine starting operations are required which often leads to a failure to operate the manual injection advance means, resulting in unstable engine starting. In addition, a large actuator is required to automatically move the piston 33 against a relatively strong force of the spring 37 when the engine is starting.

Figure 3:
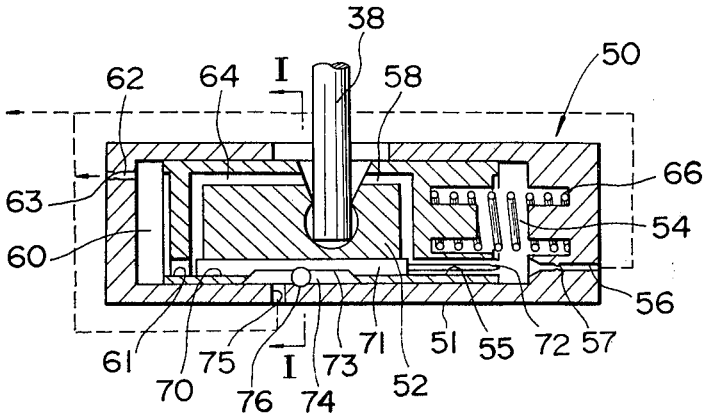
FIG. 3 is a sectional view showing one embodiment of an injection timing control device made in accordance with the present invention.

Referring now to FIG. 3, there is illustrated one embodiment of an injection timing control device made in accordance with the present invention. While the injection timing control device 50 is shown as controlling the injection timing of the fuel injection pump described in connection with FIGS. 1 and 2, it is to be noted that the present invention could readily applied to control other distributor type fuel injection pumps.

The drive pin 38 has its lower end coupled to a piston 52 by a pivotal connection. The piston 52 is located for reciprocating movement within a casing 51 secured to or formed integrally with the pump housing 10 and defines first and second pressure chambers 54 and 60 at the respective ends of the piston. The first pressure chamber 54 has an inlet port 55 communicated through a first fuel passage 58 with the pump chamber 15. The first pressure chamber 54 also has a release port 56 having therein a restriction orifice 57, the release port 56 being communicated with the exterior of the casing 51 such as the fuel reservoir. The second pressure chamber 60 has an inlet port 61 communicated through a second fuel passage 64 with the pump chamber 15 and also a release port 62 having therein a restriction orifice 62, the release port 62 being communicated with the exterior of the casing 51 such as the fuel reservoir.

A spring 66 is disposed in the first pressure chamber 54 for urging the piston 52 to the left, as viewed in FIG. 3. The spring 66 is selected to have a length, when the engine is at rest, to space the piston 52 a distance l away from the right inner surface of the first pressure chamber 53, thereby holding the piston 52 in the position providing a suitable advance to the injection timing for engine starting.

The piston 52 is formed therein with a guide bore 70 extending longitudinally of the piston 52 and in aligned relationship with the inlet ports 55 and 61. The guide bore 70 contains therein a plunger 71 adapted to reciprocate within the guide bore 70 independently of movement of the piston 52. The plunger 71 serves as a hydraulic servo valve for varying the ratio of the effective area of the first fuel passage 58 to that of the second fuel passage 64 to create a pressure difference across the piston so that the piston can move to move the roller ring 38 to an angular position. For example, the ratio of the effective area of the first fuel passage 58 to that of the second passage 64 increases as the plunger moves to the left. The plunger 71 has a length to permit the plunger to nearly close the first and second fuel passages 58 and 64 or the first and second inlet ports 55 and 61 when it is in the equilibrium position shown in FIG. 3. The plunger 71 has a needle valve 72 extending rightwardly from the right end of the plunger 71 so that the needle valve 72 closes the release port 56 when the plunger 71 moves to its rightmost position.

The plunger 71 is formed on its center portion with a rack 73 around which the piston 52 has an opening 74. The opening 74 is communicated with the inlet side of the pump 11 through a release hole 75 formed in the casing 51 in order to prevent pressureized fuel leakage. The rack 73 engages with a pinion 76.

As best shown in FIG. 4, the pinion 76 is provided on a shaft 77 driven by a reversible drive motor 80 mounted on the outer surface of the casing 51. The drive motor 80 rotates in opposite directions to move the plunger 71 toward and away from the first pressure chamber 54 through the rack-pinion connection. The reference numeral 78 designates an oil seal which is pushed against the casing 51 by the motor flange 81.

FIG. 5 illustrates a control circuit 100 for controlling the operation of the drive motor 80. The control circuit is powered through a starter switch 101 by a battery 102. The control circuit 100 has input signals from various sensors, the input signal representing engine operating parameters such as injection timing, ambient temperature, engine load, engine temperature, engine speed, etc. The control circuit 100 calculates an optimum injection timing value for the present engine operating condition in accordance with the input signals and provides a control signal indicative of the calculated injection timing value to the drive motor 80 which thereby moves the plunger 71, through the pinion 76 and the rack 73, to a target position where an advance corresponding to the calculated injection timing value is given to the injection timing.

For example, if the injection timing is required to advance, the control circuit 100 controls the drive motor 80 to rotate the pinion 76 in a counter-clockwise direction, thereby moving the plunger 71 to the left, as viewed in FIG. 3. This decreases the effective area of the second fuel passage 64 so as to restrict fuel flow through the second inlet port 61 into the second pressure chamber 60. Simultaneously, the effective area of the first fuel passage 58 is increased so as to permit increased fuel flow through the first inlet port 55 into the first pressure chamber 54. As a result, the pressure in the second pressure chamber 60 falls whereas the pressure in the first pressure chamber 54 increases, causing movement of the piston 52 to the left, as viewed in FIG. 3. The leftward movement of the piston 52 relative to the plunger 71 increases the effective area of the second fuel passage 64 and decreases the effective area of the first fuel passage 58. When the effective areas of the first and second fuel passages become equal and thus the pressures in the first and second pressure chambers become in balance, the piston 52 stops moving at a target position providing, to the injection timing, an advance corresponding to the injection timing value calculated by the control circuit 100.

To retard the injection timing, the control circuit 100 may control the drive motor 80 to rotate the pinion 76 in the clockwise direction so as to move the plunger 71 to the right, as viewed in FIG. 3. This decreases the effective area of first fuel passage 58 so as to restrict fuel flow through the first inlet port 55 into the first pressure chamber 54, and at the same time increases the effective area of the second fuel passage 64 so as to permit increased fuel flow through the second inlet port 61 into the second pressure chamber 60. Consequently, the pressure in the first pressure chamber 54 falls and the pressure in the second pressure chamber 60 increases, causing the piston 52 to move to the right. As a result of the rightward movement of the piston 52 relative to the plunger 71, the effective area of the first fuel passage 58 increases and the effective area of the second fuel passage 64 decreases. When the effective areas of the first and second fuel passages become equal and thus the pressures in the first and second pressure chambers become in balance, the piston 51 stops moving at a target position where an advance corresponding to the calculated injection timing value is given to the injection timing.

A suitable advance to the injection timing for engine starting can be obtained by moving the plunger 71 to its rightmost position. When the starter switch 101 is turned on, the control circuit 100 controls the drive motor 80 to rotate the pinion 76 in the clockwise direction so as to move the plunger 71 to its rightmost position where the plunger 71 closes the first inlet port 55 and the needle valve 72 closes the release port 56 to capture fuel in the first pressure chamber 54. This holds the piston 52 in the position held by the spring 66 when the engine is at rest against any force exerting on the piston. The resilient force of the spring 66 may be relatively weak since no pressure occurs in the second pressure chamber 60 when the engine is at rest.

If an external force acts upon the piston 52 through the drive pin 38 to move the piston 52, for example, to the right, the first fuel passage 58 opens and the second fuel passage 64 closes. As a result, the pressure increases in the first pressure chamber 54 and the pressure decreases in the second pressure chamber 60, causing the piston to move to the left. Consequently, the piston 52 stops at the initial position where the effective areas of the first and second fuel passages become equal.

Referring to FIG. 6, a modified form of the injection timing control device is shown wherein the plunger 71 is located in a guide bore formed in an upper portion of the piston 52. This modification permits formation of the first release port 56 at a position to connect an upper portion of the first pressure chamber 54 with the exterior so as to facilitate air and gas venting. This prevents air and gas accumulated in the first pressure chamber 54 from spoiling the accuracy and stability of the hydraulic control performed in the injection timing control device.

Referring to FIG. 7, another modified form of the injection timing control device is illustrated wherein a vent passage 59 is formed which communicates an upper portion of the first pressure chamber 54 with the first release port 56 to permit escape of air and gas accumulated in the first pressure chamber 54. The needle valve 72 closes the vent passage 59 and the release port 56 to capture fuel in the first pressure chamber 54 when the plunger 71 moves to its rightmost position.

Since the diameter of the plunger 71 is small and the reacting force acting upon the pinion 76 from the plunger 71 is very small, the drive motor 80 used in the injection timing control device of the present invention may be of small capacity.

It is to be noted that the needle valve 72 may be removed since the piston 52 moves with very high response to movement of the plunger 71 so that the distance between the first and second fuel passages 58 and 64 and the corresponding ends of the plunger 71 cannot exceeds 1 mm.

Figure 8:
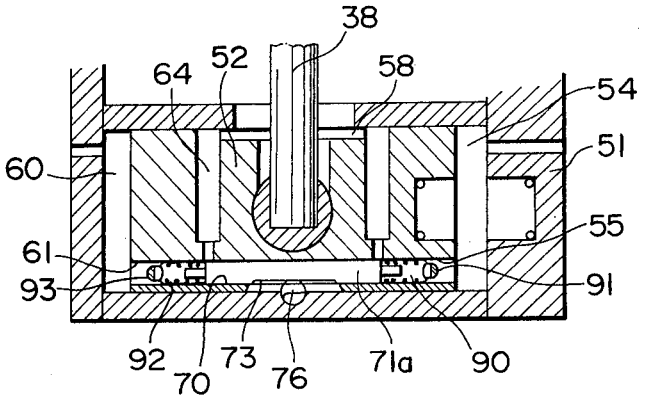
FIG. 8 is a sectional view showing another embodiment of the injection timing control device of the present invention.

Referring to FIG. 8, there is illustrated a second embodiment of the present invention. Parts in FIG. 8 which are like those in FIG. 3 have been given the same reference character. Parts which perform the same function but are slightly different in form have been given the same reference character followed by a.

Figure 9:
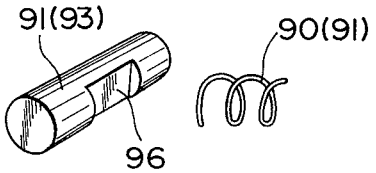
FIG. 9 is a perspective view showing a spring seat for use in the injection timing control device of FIG. 8.

The guide bore 70 contains therein a plunger 71*a* adapted to reciprocate within the guide bore. A first spring 90 is disposed between the right end of the plunger 71*a* and a first spring seat 91 fixed in the first inlet port 55. A second spring 92 is seated between the left end of the plunger 71*a* and a second spring seat 93 fixed in the second inlet port 61. The first and second springs 90 and 92 have the same spring constant. The first and second spring seats 91 and 93 are of rod shape having a size sufficiently smaller than the effective area of the associated inlet ports 55 and 61 to assure smooth fuel flow through the inlet ports. As shown in FIG. 9, each of the spring seats 91 and 93 may be formed therein with a groove 96 having a flat bottom in order to prevent the associated spring from coming off.

If the drive motor 80 moves the plunger 71*a* to the left from an equilibrium position shown in FIG. 8 in order to advance the injection timing, the second spring 92 is compressed to increase its resilient force urging the plunger 71*a* to the right and the first spring 90 is expanded to decrease its resilient force urging the plunger 71*a* to the left.. The resultant resilient force urging the plunger 71*a* to the right increases as the plunger 71*a* moves to the left. When the resultant resilient force increases to a value equal to the force transmitted through the pinion 76 and the rack 73 from the drive motor 80 to move the plunger 71 to the left, the plunger 71*a* stops moving at a new equilibrium position. At this time, the plunger 71*a* increases the effective area of the first fuel passage 58 so as to permit increased fuel flow through the first inlet port 55 into the first pressure chamber 54 and decreases the effective area of the second fuel passage 64 so as to restrict fuel flow through the second inlet port 61 into the second pressure chamber 60. As a result, the pressure increases in the first pressure chamber 54 and the pressure falls in the second pressure chamber 60, causing movement of the piston 52 to the left.

The leftward movement of the piston 52 moves the first and second spring seats 91 and 93 to the left with respect to the plunger 71*a* so as to compress the first spring 90 and expand the second spring 92 to some extent, reducing the resulting resilient force urging the plunger 71*a* to the right. This permits the drive motor 80 to move the plunger 71*a* further to the left. These operations are repeated until the plunger 71*a* reaches a target position providing, to the injection timing, an advance corresponding to the injection timing value calculated by the control circuit 100. The plunger 71*a* moves to a new equilibrium position in a very short time.

To retard the injection timing, the control circuit 100 may control the drive motor 80 to move the plunger 71*a* to the right through the rack 73 and the pinion 76. The resultant resilient force uring the plunger 71*a* to the left increases as the plunger 71*a* moves to the right. The plunger 71*a* stops moving at a new equilibrium position when the resultant resilient force urging the plunger 71*a* to the left increases to a value equal to the force transmitted from the drive motor 80 to the plunger 71*a*. At the new equilibrium position, the plunger 71*a* increases the effective area of the second fuel passage 64 so as to permit increased fuel flow through the second inlet port 61 into the second pressure chamber 60 and decreases the effective area of the first fuel passage 58 so as to restrict fuel flow through the first inlet port 55 into the first pressure chamber 54. As a result, the pressure decreases in the first chamber 54 and the pressure increases in the second pressure chamber 60, causing movement of the piston 52 to the right.

The rightward movement of the piston 52 moves the first and second spring seats 91 and 93 to the right so as to expand the first spring 90 and compress the second spring 92 to some extent, reducing the resultant resilient force urging the plunger 71*a* to the left. This permits the drive motor 80 to move the plunger 71*a* further to the right. These operations are repeated until the plunger reaches a target position where an advance corresponding to the injection timing value calculated by the control circuit 100 is given to the injection timing.

In the course of movement of the plunger 71*a* to a target position, the plunger stops at equilibrium positions under the resultant resilient force of the springs urging the plunger in the direction opposite to the direction of movement of the plunger. Thus, the time required for the drive motor 80 to move the plunger 71*a* to a target position is increased to some degree permitting to operate the drive motor 80 under the feedback control of the control circuit 100. The plunger 71*a* can move to the target position with high accuracy without overshoot. This eliminates the possibility of the plunger 71*a* from smashing into the casing which would result in failures of the drive motor 80, the rack 73 and the pinion 76.

While this invention has been described in connection with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. A distributor type fuel injection pump for use with a diesel engine for successively supplying pressurized fuel to engine injectors in synchronism with engine rotation, said fuel injection pump including an angularly movable control member adapted to determine the timing of fuel injection in accordance with its angular position, and an injection timing control device for varying the angular position of said control member, said injection timing control device comprising:

(a) a casing (b) a piston drivingly connected to said control member and located for reciprocating movement within said casing to form first and second pressure chambers at the respective ends thereof, said first pressure chamber having a first release port and a first inlet port, said second pressure chamber having a second release port and a second inlet port, said piston formed therein with first and second pressure passages, said first pressure passage communicating a pressure source with said first inlet port, said second pressure passage communicating said pressure source with said second inlet port;

(c) control circuit means for calculating an optimum injection timing value for an engine operating condition from various engine operating parameters and providing a control signal indicative of the calculated injection timing value; and (d) valve means responsive to the control signal from said control circuit means for varying the ratio of the effective area of said first pressure passage to that of said second pressure passage to create a pressure difference across said piston, whereby said piston moves to move said control member to an angular position corresponding to the calculated injection timing value.

2. A fuel injection pump as set forth in claim 1, wherein said valve means comprises a plunger located for reciprocating movement within a guide bore formed in said piston in aligned relationship with said first second inlet ports, and drive means for moving said plunger to a target position corresponding to the calculated injection timing value.

3. A fuel injection pump as set forth in claim 2, further comprising resilient means for urging said plunger in the direction opposite to the direction of movement of said plunger.

4. A fuel injection pump as set forth in claim 3, wherein said resilient means comprises a first spring having its one end fixed in said first inlet port and the other end thereof being seated on one end of said plunger, and a second spring having its one end fixed in said second inlet port and the other end thereof being seated on the other end of said plunger.

5. A fuel injection pump as set forth in claim 4, wherein said first and second springs have the same spring constant.

6. A fuel injection pump as set forth in claim 2, wherein said plunger nearly closes said first and second pressure passages when it is in an equilibrium position.

7. A fuel injection pump as set forth in claim 2, wherein said plunger has a needle valve extending from its one end toward said first inlet port for closing said first release port when said plunger is in its position nearest to said first pressure chamber.

8. A fuel injection pump as set forth in claim 7, wherein said plunger nearly closes said first and second pressure passages when it is in an equilibrium position.

9. A fuel injection pump as set forth in claim 2, wherein said drive means comprises a rack formed on said plunger, a pinion engaging said rack, and a drive motor responsive to the control signal from said control circuit for rotating said pinion.

10. A fuel injection pump as set forth in claim 2, further comprising means for placing said piston at a position providing a suitable advance to the injection timing for engine starting.

11. A fuel injection pump as set forth in claim 10, wherein said means is a spring located in said first pressure chamber, said spring having a length, when said engine is at rest, to place said piston at a position providing a suitable advance to the injection timing for engine starting.

* * * * *